US005836695A

United States Patent [19]

Hanson

[11] Patent Number: 5,836,695

[45] Date of Patent: Nov. 17, 1998

[54] BAG WITH INVERTED LOOP HANDLE

[76] Inventor: Violet Hanson, 14 Fairway Dr., Old Bethpage, N.Y. 11804

[21] Appl. No.: 741,561

[22] Filed: Oct. 31, 1996

[51] Int. Cl.[6] ..... B65D 33/10

[52] U.S. Cl. ..... 383/14

[58] Field of Search ..... 383/14, 6

[56] References Cited

U.S. PATENT DOCUMENTS

| | | | |
|---|---|---|---|
| 2,625,318 | 1/1953 | Ross | 383/14 |
| 3,251,390 | 5/1966 | Evans | 383/14 X |
| 3,722,377 | 3/1973 | Hayes | 383/14 X |
| 5,346,708 | 9/1994 | Carson | 383/14 X |

FOREIGN PATENT DOCUMENTS

| | | | |
|---|---|---|---|
| 5032258 | 2/1993 | Japan | 383/14 |
| 418124 | 10/1934 | United Kingdom | 383/14 |

*Primary Examiner*—Jes F. Pascua
*Attorney, Agent, or Firm*—Bauer & Schaffer

[57] ABSTRACT

A plastic flat bottom bag is provided with a handle, which is attached while the handle is flat against the surface of the bag and is directed downwardly toward the flat bottom.

2 Claims, 1 Drawing Sheet

BAG WITH INVERTED LOOP HANDLE

RELATED DOCUMENT

The contents of this application have been disclosed, in part, in Disclosure Document No. 404,093, dated Aug. 29, 1996.

BACKGROUND OF THE INVENTION

The present invention relates to an improvement in flat bottom plastic bags and, in particular, to the construction of such bags with a handle or handles.

In my U.S. Pat. Nos. 3,924,521; 3,970,241; 3,988,970; 4,230,030; 4,892,511; and 4,929,244 and my copending U.S. Pat. application Ser. No. 08/543,261, I have disclosed methods for the construction of flat bottom bags made of thin plastic material. Because of the methods employed in manufacture and because of the nature of thin plastic material used, it has not been, heretofore, possible to construct a flat bottom bag having integral handles at its upper edges. Thus, while plastic flat bottom bags have benefit in strength, weight and ability to be filled, over conventional Kraft paper bags, they do not have the upper body rigidity allowing them to be carried as comfortably as a paper bag.

It is the object of the present invention to provide flat bottom plastic bags with handles.

It is an object of the present invention to provide flat bottom plastic bags which are easier and more comfortably carried.

These objects as well as others, together with the several advantages of the present invention, will be apparent from the following disclosure.

SUMMARY OF THE INVENTION

These bags simulate the conventional Kraft shopping bags in that the open end has a continuous edge and is without handles.

In accordance with the present invention, a flat bottom plastic bag is provided with a handle. The handle is formed of a strip of plastic material, preferably the same material as the bag. The handle is attached at its ends to the surface of each of the front and rear panels of the bag while lying flat against these surfaces. Preferably, the attachment is made by heat welding the ends to the bag panels so as to have a terminal line collinear.

In use, the handles are raised and folded over the welded ends, thus hiding the end of the handles and providing a balanced grasp.

Full details of the present invention are set forth in the following description and are illustrated in the accompanying drawings.

DESCRIPTION OF THE INVENTION

Figure 1:
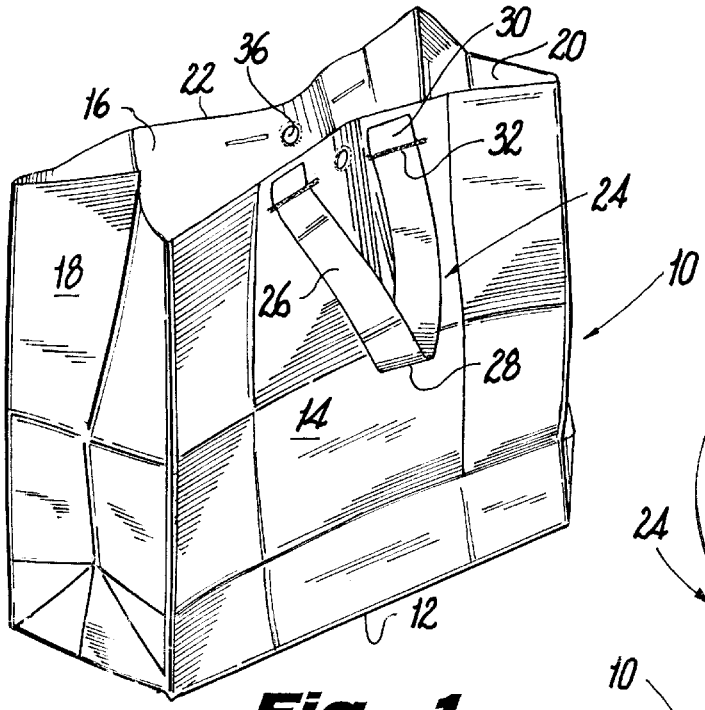
FIG. 1 is a perspective view of an upright, flat bottom, plastic bag showing the application of a handle to one side thereof, a handle being similarly applied to the other side of the bag.

As seen in FIG. 1, a flat bottom plastic bag, generally depicted by the numeral 10, has been placed in open upright position, resting on its flat rectilinear bottom 12. The bag 10 is formed with rectilinear front and rear panels 14 and 16, respectively, as well as rectilinear side panels 18 and 20. The upper edge 22 of the bag is open, providing a wide rectilinear mouth into which the items to be carried are inserted.

In accordance with the present invention, a handle 24 is attached to each front and rear panel 14 and 16, respectively. The handle 24 is formed by first cutting flat linear strip 26, preferably from the same sheet material as that from which the bag itself is made, although this identity of material is not critical. The length and width of the strip 26 is not critical, although they must be selected for convenience and decorative in use. A length approximately between 8–15 inches and a width of 1–2 inches would be suitable.

The flat linear strip 26 is folded at its mid line 28 to form a generally V shape and placed flat against the surface of the respective front and rear panels so that its mid line 28 is placed along the center line of the respective front and rear panels, and the arms and tips of the V extend upwardly toward the upper edge 22 and symmetrically toward the side panels 18 and 20.

In this inverted position, the tips 30 of the V-shape handle are heat welded to the panel so as to form a permanent lasting bond. If desired, the tips 30 may be otherwise sealed to the panel such as with a strong chemical adhesive bond. In either case, the heat weld or seal should extend at least 1½ inches to 1 inch to assume complete adherence to the bag panels and sufficient strength in use. The individual heat welds or adhesive bonds terminate in defined lines 32, which extend transversely to the center axis of the panels. The line 32 of each handle being collinear. During the welding, the apex of the bent strip is pointed downwardly toward the bottom of the bag.

Figure 3:
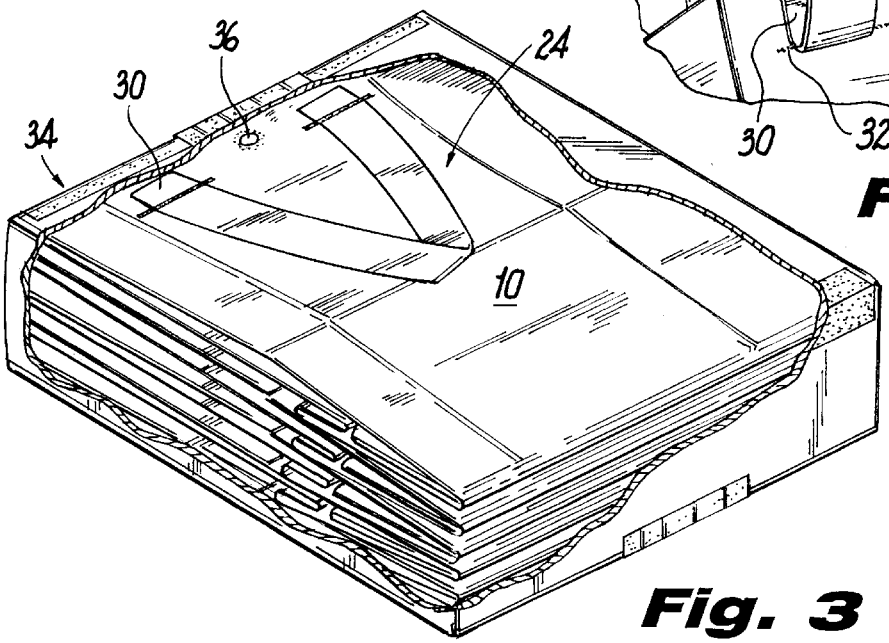
FIG. 3 is a perspective view of a stack of bags in a shipping and storage container.

After completion, the bags 10 are folded flat and stacked one upon the other for shipment and storage, with the bent strip handle 24 remaining folded and inverted. Such a stack assumes a general rectangular configuration, which can then be easily packaged in a more rigid storage and shipping container 34, as seen in FIG. 3.

Figure 2:
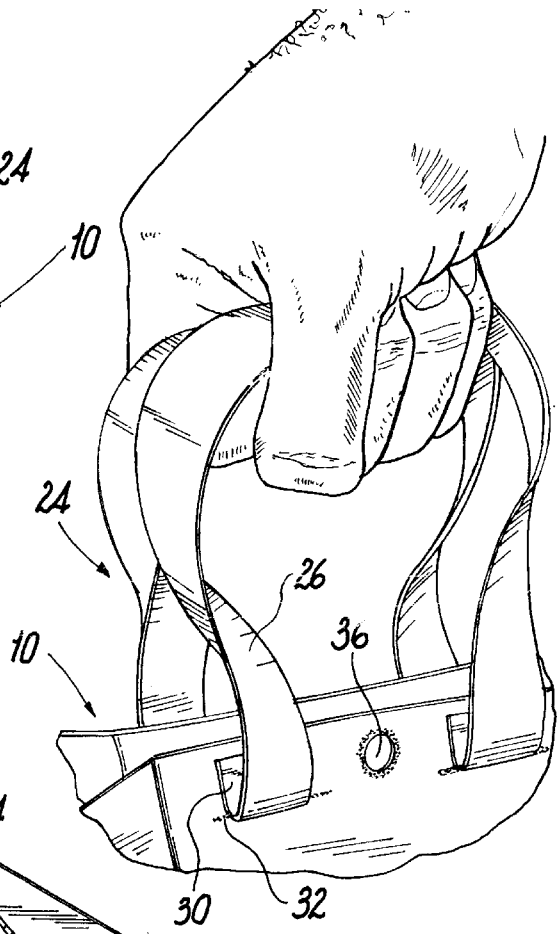
FIG. 2 is a partial view of the bag of FIG. 1, showing the handle in position of use.

In use, the user opens the bag in the usual manner and generally fills the bag 10 with merchandise such as produce, groceries, or packaged goods, household waste or the like, as bags are normally used. The handles 24 are then grasped and lifted upwardly (FIG. 2). As a result, the tips 30 secured to the panel remain intact and integral with the respective front and rear panels 14 and 16, even while the material of the handle is folded over the upper tips 30 as seen FIG. 2. Thus, the arms of the handle 10 fold over the tips 30 along lines 32 so that the tips 30 lie inside the handle 24 but outside the outer surface of the panels 14 and 16, being protected during use from rain and jostling. Since the lines 32 are collinear, pull on the handles is balanced from one side to the other during use.

While the cutting of the handle strip 26 from sheet stock is in linear form, the handle strip can be cut in an arcuate manner so as to obviate the need to fold the strip in at the middle to define the lateral arms. This, of course, will be somewhat more costly in manufacture as it will result in some waste material; however, it may be somewhat more decorative. The handle strip material may also have a different color or ornamentation than the bag and may be a different gauge or thickness.

If desired, the bag 10 may be punctured near its upper edge 22, providing a hole 36 along the mid-line of the front and rear panels. The hole 36 is preferably reinforced about its periphery within an annular boss or ring form by a heat weld. The hole 36 provides efficient and simple means for rack packing any number of bags on a holder or support.

It will be seen from the foregoing that the present invention provides a flat bottom plastic bag with a durable, high-strength handle, which is easy to form and attach to the panels of the bags. The bags so formed are easy to stack, one upon the other, and take up less space because their handles do not extend outwardly. Thus, packing and shipping will be less expensive.

Various modifications and changes have been disclosed herein, and others will be apparent to those skilled in this art. Therefore, it is to be understood that the present disclosure is by way of illustrating and not limiting of the present invention.

I claim:

1. In a plastic flat bottom bag having front, rear and side panels extending upwardly from the flat bottom, a handle for each of its front and rear panels, each said handle comprising a strip of plastic material lying flat against the outer surface of the respective panel with the ends of said strip forming a tab adjacent the upper edges of the respective panels and the main body of the strip directed downwardly toward the flat bottom, said tabs being heat welded directly to the outer surface of the panels along collinear lines so that in use the main body of the strip is folded over the attachment line, said attachment line extending beyond the edges of the strip to reinforce said panel.

2. The plastic flat bottom bag according to claim 1, wherein said handles and said bag are made from the same plastic material.

* * * * *